US007232956B2

(12) United States Patent
Howe

(10) Patent No.: US 7,232,956 B2
(45) Date of Patent: Jun. 19, 2007

(54) INTERCONNECTING CABLE

(76) Inventor: Eugene Howe, 24 Elm Court, Highburton, Kirkburton, Huddersfield HD8 OTB (GB)

( * ) Notice: Subject to any disclaimer, the term of this patent is extended or adjusted under 35 U.S.C. 154(b) by 0 days.

(21) Appl. No.: 10/507,092

(22) PCT Filed: Mar. 7, 2003

(86) PCT No.: PCT/GB03/01005

§ 371 (c)(1),
(2), (4) Date: May 5, 2005

(87) PCT Pub. No.: WO03/075287

PCT Pub. Date: Sep. 12, 2003

(65) Prior Publication Data

US 2006/0090922 A1 May 4, 2006

(30) Foreign Application Priority Data

Mar. 7, 2002 (GB) ..... 0205323.9
Sep. 3, 2002 (GB) ..... 0220502.9

(51) Int. Cl.
*H01B 7/00* (2006.01)

(52) U.S. Cl. ..... 174/113 C; 174/29; 174/36; 174/113 R; 174/131 R; 174/131 A

(58) Field of Classification Search ..... 174/113 C, 174/29, 131 A, 113 R, 131 R, 36
See application file for complete search history.

(56) References Cited

U.S. PATENT DOCUMENTS 5,969,295 A * 10/1999 Boucino et al. ..... 174/113 C

FOREIGN PATENT DOCUMENTS

WO WO 01/54139 A1 * 7/2001

* cited by examiner

*Primary Examiner*—Jinhee Lee
(74) *Attorney, Agent, or Firm*—Bernhard Kreten; Audrey A. Millemann; Weintraub Genshlea Chedial

(57) ABSTRACT

The invention is a cable and a method of producing a cable. The cable can be adapted and used for the generation of audio, video, data, electrical supply and other uses and includes at least two conductor sets running along the cable, Each conductor set includes at least two conductors wound or twisted round each other with a known degree or ratio of twist. The conductor sets are spaced apart as they run along the cable. This may be achieved by an elongate member along the cable to retain the spacing of the conductor sets. If required and with reference to the spacing between sets, the degree or ratio of twist or winding of the conductors in each set can be varied between sets. The cable has significantly improved performance with respect to conventionally available cables.

16 Claims, 16 Drawing Sheets

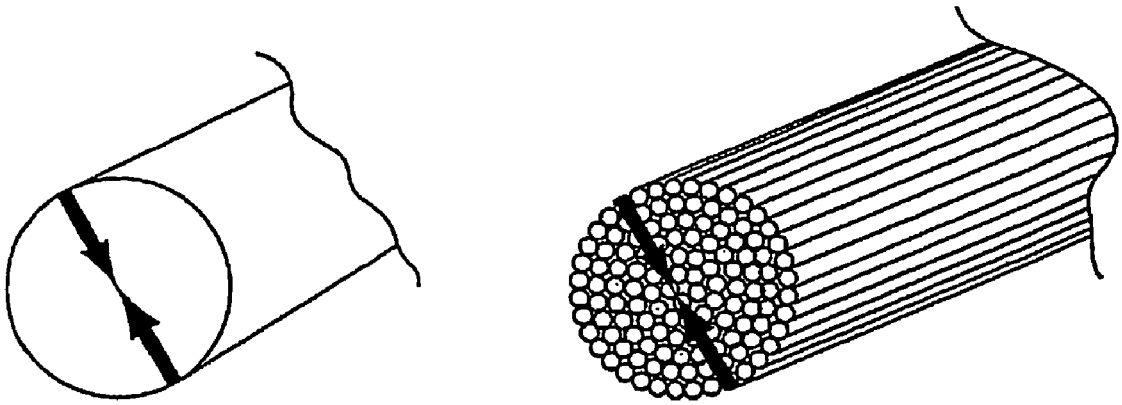
FIG. A
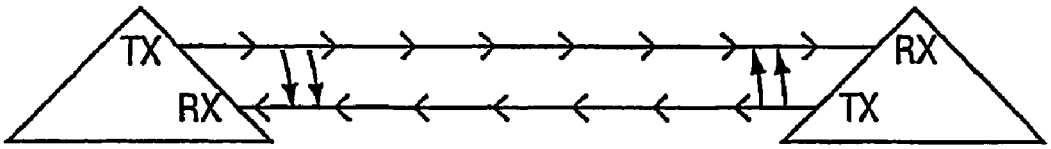
FIG. B

MicroTest Diagnostics Analyzer (TM) [BETA] (OmniDemo)
File Config Ref Curve Del Curve Options Category Acquire
C5 Basic
10.0 /DIV
-10.0
C5E Basic
C3 Basic
OMNIAnalyzer(TM) Far End CrossTalk Scatter
Time
Diff
MHz
300.0

INTERCONNECTING CABLE

The invention which is the subject of this application relates to an improvement in the provision of cables of the type which can be used for the carrying of electrical power or signals such as data transmission, video, audio, auxiliary data or indeed any communication data in Alternating Current, Direct Current, analogue or digital format between two or more locations. The cable in accordance with the invention is provided in a form to improve the transfer of data in terms of improved quality, reduced interference, increase in throughput/bandwidth to make the same more commercially attractive to potential purchasers while, at the same time, improving the performance of the same.

By formation of the conductors and sympathetic conductor sizing and/or conductor shape within a cable in accordance with the invention the cable of the invention has been found in tests to reduce distortion and interaction and hence reduce data signal degradation between apparatus and to improve the transmission and efficiency of transmission of electrical signals whether in Alternating current, Direct Current, analogue or digital format and improve high speed data transmission.

The invention relates to improvements to the cable and the conductors within the cable to produce a data transmission medium which is found to be of advantage in conducting audio, video, data signals and/or power between electrical apparatus, and associated supplies to the apparatus.

At the present time, conventional cable (which is used to conduct signals between electrical components and provide supplies to the same) has several disadvantages in that typical designs consist of single or multiple conductors arranged to act as a transmission line. However the arrangements make the cable susceptible to distortion in that signals which are carried along the line deteriorate as they pass along the same and hence signal strength interference and other degradations are apparent.

With conventional cable which utilises a solid conductor some signal deterioration can be caused by a physical constant known as "the skin-effect". The "skin-effect" herein described acts to reduce the current density passing along the conductor at distances away from the surface of the conductor as illustrated in Prior Art Figure A. This then leads the currents to tend to crowd towards the surface of the conductor which effectively reduces the "usable" cross sectional area of the conductor and an increase in resistance thus causes degradation in the overall efficiency of the cable. In higher current cabling, the cross sectional area of the conductor tends to need to be relatively large e.g. >0.8 mm 18 Am Wire Gauge in order to accommodate higher currents therethrough. The increase in the cross-sectional area is proportional to the skin-effect and can lead to a significant factor in the deterioration of signals.

With conventional stranded conductors, the skin-effect problem can still apply if the strands are uninsulated and bundled together to give, in effect, a single conductor with an overall cross-sectional area which is large enough to cause the above problems described with regard to solid core conductors as shown in Prior Art Figure A.

When several conductors are used to make up a cable another major problem arises and that is one of magnetic interaction. It is known that when a current is passed through a conductor a magnetic field is set up around it and if this problem is not addressed in the cable design then poor results in terms of accuracy, efficiency and quality occur in terms of error in transmitted data and cross talk between conductor sets as shown in Prior Art Figure B.

Furthermore, if two or more conductors are provided to run parallel within a cable, each will have a magnetic field set-up around the same and this field can effectively interfere with the data/signal passing along the other conductor, and vice versa and this problem is experienced and multiplied if further conductors and increase in currents are involved. This problem gives rise to signal conflict along the length of the cable and particularly within e.g. audio or video where currents of differing value exist. Higher current signals create greater magnetic fields that damage the smaller current smaller field signals thus distorting and altering the original source signal.

A further problem is that a conventional cable which comprises a series of conductors is susceptible to causing degradation to the signals which are carried along the same. These changes are caused by magnetic interaction between the conductors. These changes cause the signal at its receiving end to be less than optimum. Musical timing is also a factor to consider in poorly designed audio/video cabling due to differing wavelengths occurring at the same or sporadic times throughout a performance. This effect also carries to mains as current is drawn from the power supply.

The sound produced, for example in audio, can, thus, be fuzzy and/or the higher or lower margins of the sound limit which are produced are not reproduced to an optimum.

In general the larger the bundle of conductors, the larger the problem. To reduce signal degradation it is commonly held that the quantity of conductors should be kept small and therefore many conventional cables attempt to minimize the size of the bundle of conductors to minimise the induction. Furthermore the movement of the strands within the cable can cause points to occur in the cable where distortion is considerably greater than at other points along the length of the cable.

Techniques which are used to attempt to reduce this problem are to provide, as for example, in Category 6 or 7 cable, sets of conductors in conjunction with an elongate member, which is used to separate the four sets of twisted pairs and is located inside the cable, so as to guide and twist the paths of each of the conductor sets along the cable as they pass along the length of the same. This twisting, or "lay", as it is known is difficult to achieve, extends the length of the conductors which are required to provide a particular length of cable and therefore increases the cost of the cable. By using the principle of spacing, as outlined throughout this application, the conductors by air or otherwise, renders the aforementioned process unnecessary although may be carried out if minimal cross section area of the cable is required.

The quality and/or purity of material used in the cables is also regarded as a further method by which the performance of the cable can be increased.

The aim of the present invention is to provide a conductor arrangement which is of a form and manner to overcome the problems as set out previously and also to provide conductor sockets to allow the same to be utilised in the most efficient manner.

In a first aspect of the invention there is provided a cable which has at least two conductor sets provided to run along the same, each of said conductor sets including at least two conductors twisted or wound around each other and wherein said at least two conductor sets are kept physically spaced apart by a distance of at least 1 mm as they run along said cable.

In one embodiment the cable includes an elongate member which acts to space the conductor sets the required distance apart. Preferably the conductor sets are spaced apart by 2 mm or more.

In one embodiment at least one of the conductor sets is twisted around the outside of an elongate member as it passes there along. The elongate member can be a tube or rod or indeed of any suitable cross sectional shape, examples of which follow. The elongate member can be formed of insulating material or conducting material and, if formed of conducting material can act as a ground wire conductor and/or former where a non shielded cable is permissible for application.

Typically each conductor set forms what can be referred to as a conduction path. Typically the conductors used are insulated and the cross sectional area is variable according to specific requirements and chosen to give optimum conductivity without causing skin effect thereby further increasing the effectiveness. With respect to some applications e.g. data, each conductor set can allow the passage of data in both directions.

In one embodiment the elongate member has a passage, said passage housing a first conductor set and a second conductor set is positioned to run along the outside of said member. In one embodiment the second conductor set is wound around the elongate member or is provided to run straight along the elongate member. In one arrangement the second conductor set is of higher resistivity than the first conductor set and the degree of twist between the respective conductor sets is different. The principle of providing a conductor set comprising twisted pairs of conductors together is to create a 'balanced' line. Twisted pairs are known to reduce emission, give lower pick-up noise and produce an effective noise rejection characteristic. This means that by keeping the conductors in the set close together e.g. twisting gives a signal voltage that adds up to zero (due to the fact that the signal strength is equal but opposite in force) at any point on the twisted pairs' path. e.g. if a twisted pair is 10 metres long and is sending 2 volts, flow and return, and we test at, for example, 2 metres, with a volt meter, from the signal/voltage source the total value will be zero. When external noise is present on the two conductors the force created will be common on both conductors (equal but opposite) and will cancel out especially if there is an inductive piece of apparatus attached to one end of the cable.

If required the passage can be provided with location points to locate the first conductor set therein.

In addition to the spacing of the conductor sets being 1 mm or greater the degree of twist or winding of the conductors in each set can be varied between respective sets so as to improve the performance of the cable. For example, if the spacing between adjacent sets is relatively small, then the difference in the degree of twist or winding of the conductors in respective conductors is increased, and if the spacing is larger, the difference required is reduced. Thus the variation between the degree of twist or winding of conductors in respective conductor sets is typically determined with reference to the relative spacing between the adjacent conductor sets.

When one of the conductor sets is wound around the elongate member then for that length of cable, that conductor set is typically longer in length than the other conductor set(s) as it is wound around the cable rather than being straight. Typically that conductor set is of higher resistivity than the other conductor set due to its increased length. Alternatively the inner conductor set may be of tighter twist density than the outer conductor set, thereby reducing or eliminating the length differential. The length differential between the respective conductor sets act as a separator for different transmission frequencies and current/voltage weighting.

In a further aspect of the invention there is provided a data cable for the transfer of data between two locations, the cable comprising a series of conductors selectively grouped together into at least two conductor sets, each set having at least two conductors twisted or wound with respect to each other, each set spaced by an elongate member and wherein said conductor sets are positioned to run substantially straight along the cable.

Typically the said at least two conductor sets are positioned to run along the cable with no lay.

In one embodiment at least one conductor set is mounted within an elongate member to pass therealong and one or more conductor sets are positioned on the external surface of the elongate member.

In one embodiment the cable comprises four sets of conductors, each set comprising at least two conductors twisted or wound and each of the sets spaced apart by at least 1 mm, but more preferably by 2 mm or greater. In one embodiment the cable cross section is substantially circular and the conductor sets are spaced apart substantially 90 degrees between adjacent sets. If more or less conductor sets are provided the angular spacing can be 360 degrees divided by the number of conductor sets.

In one embodiment the conductor sets are arranged to lie inside the passage of the elongate member and typically adjacent the inner surface of the wall thereof. Alternatively the conductor sets can be spaced apart by positioning on the outside of the elongate member or yet further the sets of conductors are located within the wall of said elongate member.

In whichever embodiment, it is envisaged that in each set of conductors, the conductors are twisted/wound round one another so as to form a twisted set of conductors. In practise, depending on the application type, the degree of twist of the conductors in each set is of a specific tightness but kept as loose as possible without detracting from the performance of the cable so as to provide cost savings by reducing the lengths of the conductors by reducing the degree of twist. It is also the case that in many embodiments the conductor sets and elongate member are housed within an external shroud or suitable housing to protect same from damage in the same way as conventional cables.

Typically the conductor sets are spaced apart, preferably by 1 mm or more apart and/or the twisting tightness of each set will be staggered e.g. set Pr1=4 twists/cm, set Pr2=3 twists/cm, set Pr3=2 twists/cm or whatever is most effective, depending on application. Thus as the spacing apart increases the difference in twist can decrease and as the spacing decreases the difference in relative twist can be increased. This will reduce the crosstalk and improve the performance.

Typically each of the conductors is insulated from the others by insulating material and the cable includes an outer housing of insulating material.

Typically the cable includes an elongate member, said member locating thereon or therein, a plurality of conductor sets, said conductor sets provided at spaced locations to pass along and/or within the elongate member with the spacing being 1 mm or greater between adjacent conductor sets.

In one embodiment the elongate member is in the form of a tube and the conductor sets lie on any or any combination of the inside or outer surfaces of the tube wall and/or within the wall itself.

In one embodiment the conductor sets are wound around each other and/or the elongate member. In an alternative and preferred embodiment the longitudinal axes of each of the conductor sets run substantially parallel to the longitudinal axis of the elongate member.

If required to further improve the performance of the cable the degree of twist or winding of the conductors in each set is varied with respect to that of the other sets of conductors with the degree of difference increased as the spacing between the respective conductor sets is reduced.

Preferably, if the cross sectional area of the cable is large enough i.e. the distance between pairs is acceptable, each of the sets of twisted conductors are provided at the same density to minimise, or indeed cancel out, any propagation delay in the data transferred along the cable.

Preferably each of the sets of twisted conductors are provided at the same density to minimise any propagation delay in the data transferred along the cable.

In one embodiment at least one conductor set passes along the elongate member passage substantially in parallel with the longitudinal axis of the cable. Preferably each of the conductor sets runs in a straight linear path in parallel with the longitudinal axis of the cable. Alternatively one or more of the conductor sets is wound around the elongate member in a substantially helical path.

It is preferred to have the conductor sets running in a linear path rather than a lay or spiral path along the elongate member as it reduces the length of conductor material required to be used to form the cable, hence reducing costs of production of the cable and in due course the selling price of the cable, without affecting the performance of the same.

In one embodiment the passage or space in the elongate member carries services therealong, for example, a mains supply.

In a further aspect of the invention there is provided a plug for use with a cable of the type described herein, said plug having a body arranged for location within a socket and wherein said plug has reception means for the connection of a plurality of spaced conductor sets, said reception means spaced apart on the plug body.

Typically the spacing between conductor set reception means is at least 1 mm and, if the plug body is circular cross section, by 360° divided by the number of conductor set reception means provided.

Preferably the reception means for the conductor sets are connected to metallic contacts to allow connection and transmission of a signal from the conductor sets to metallic contacts in the socket into which the plug is inserted.

In one embodiment the plug body is substantially circular in cross section or, alternatively the plug body is substantially flat and planar in shape.

In a further aspect of the invention there is provided a socket for use with a cable of the type described herein said socket having a port for reception of a plug and wherein said socket has reception means for the connection of a plurality of spaced conductor sets, said reception means spaced apart at the socket port.

In one embodiment the angular spacing between conductor set reception means is 360° divided by the number of conductor set reception means provided.

In one embodiment the reception means for the conductor sets are connected to metallic contacts to allow connection and transmission of a signal from the conductor sets to metallic contacts in the plug inserted in the socket port.

In one embodiment the socket port is substantially circular in cross section or, alternatively is a substantially flat slot.

Although the provision of the plug and socket bodies of a substantially cylindrical form along with a locator means to ensure correct location of the plug and socket bodies on each occasion may be preferred, other shapes of plug and socket bodies can be used as long as they maintain the spacing between the respective conductor sets. For example, the plug and socket shapes used can be any or any selection of square, oval, oblong, rectangular, hexagonal and the like.

In one embodiment, the cable is located with respect to the plug or socket body substantially in line with the same. Alternatively, the socket or plug body can be mounted at 90° to the longitudinal axis of the cable.

In whichever embodiment, if a shielded cable is required a metal braided sleeve can be passed over the conductor sets or the individual conductor sets or transmission lines. Shielding the cable can reduce external R.F noise and increase mechanical strength.

Each conductor referred to herein may in fact comprise a series of wires wound together to form one of said conductors.

Typically, the tightness of twist of the conductor around each other conductor in the set is constant in that set. In one embodiment the tightness of twist differs from set to set in a stepped fashion from a tightest twist in a first set to a loosest twist in the last set.

It has been found that the above arrangement of conductor sets and particularly when utilised with the plug and sockets as described, allows greater bandwidth, less cross talk, reduced induction, capacitance, resistance and a greater attenuation cross talk ratio which, reduces the distortion of sound or video reproduction components and from the power supply to each. Similarly, beneficial effect has been found when the same is used for data transfer such as, for example, to connect high speed data networks hubs. Thus in a further aspect of the invention there is provided a connector cable, said cable comprising a series of conductor sets arranged in accordance with the embodiments herein described and at each end of the cable there is provided a plug or socket according to the embodiments as herein described.

Typically when the cable is used to connect e.g. hi-fi components, left and right input and output connectors are required and this may be achieved by providing two separate cables to increase quality. Alternatively, two cables can be placed into one sheath but a slight reduction in quality will occur.

In a further aspect of the invention there is provided a method for forming a cable which includes a series of conductor sets, each of said sets including at least two conductors which are twisted/wound about one another to form the set and the degree of twist/winding ratio of each of the sets is compared with the twist ratios for each of the other sets and also the required spacing between the sets as they run along the cable and on the basis of this comparison the degree of twist/winding ratio of the conductors in each conductor set are varied with respect to the other conductor sets, if required to improve the performance of the cable.

In one embodiment the difference between the degree of twist/winding ratios increases progressively through the adjacent spaced conductor sets. The level of variation in the degree of twist/winding increases as the required spacing between the conductor sets reduces.

The insulating material for the elongate member and/or outer housing is specific to the application and any insulating material, including specialist materials, can be used. Further shielding in the form of braided, foil or other sleeving placed over the entire cable or individual conductors will act to reduce external RF interference and increase mechanical strength.

Specific embodiments of the invention will now be described with reference to the accompanying drawings wherein:—

FIGS. A and B show prior art conductor configurations.

FIGS. 1A and 1B indicate embodiments of the invention with one core provided with an elongate member in the form of a tube or ground wire to form a conductor;

FIGS. 2A and 2B illustrate an arrangement of two conductors and one tube and/or ground wire;

FIGS. 3A–C illustrate a further embodiment of the invention;

FIGS. 4A–B illustrate a further embodiment of a cable in accordance with the invention;

FIGS. 5A–F illustrate cross sections of the cable in several embodiments;

Figure 13A:
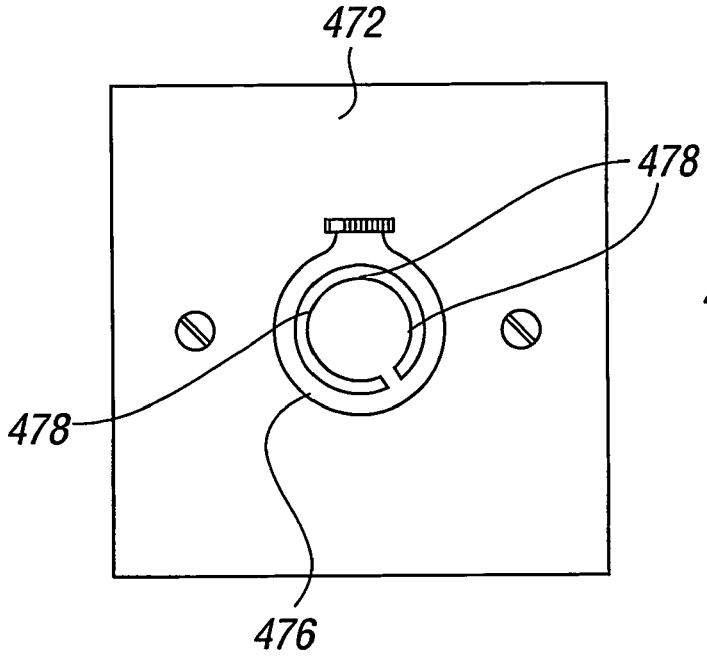
Figure 13B:
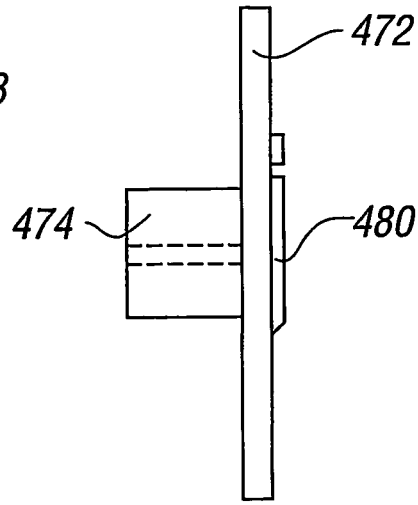
Figure 14A:
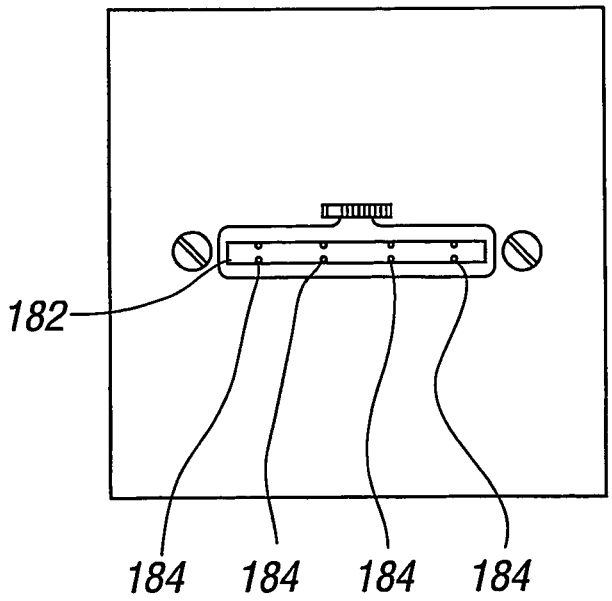
Figure 14B:
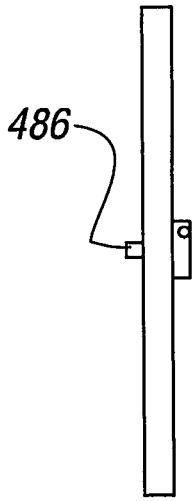
Figure 15A:
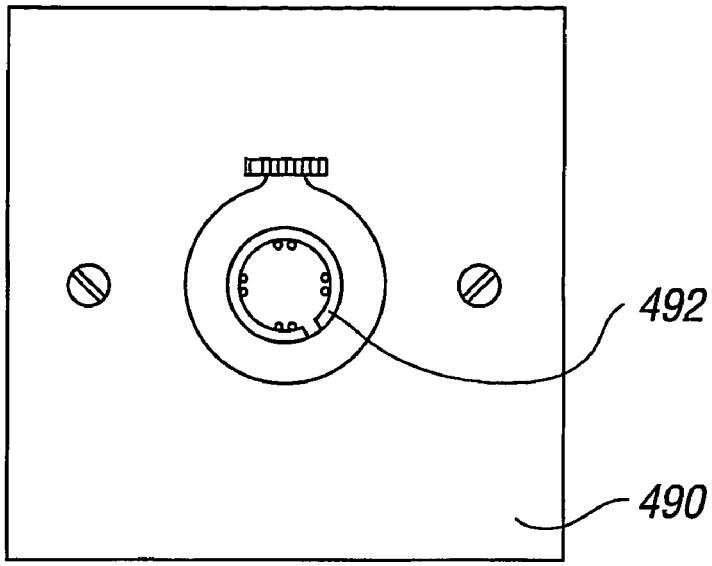
Figure 15B:
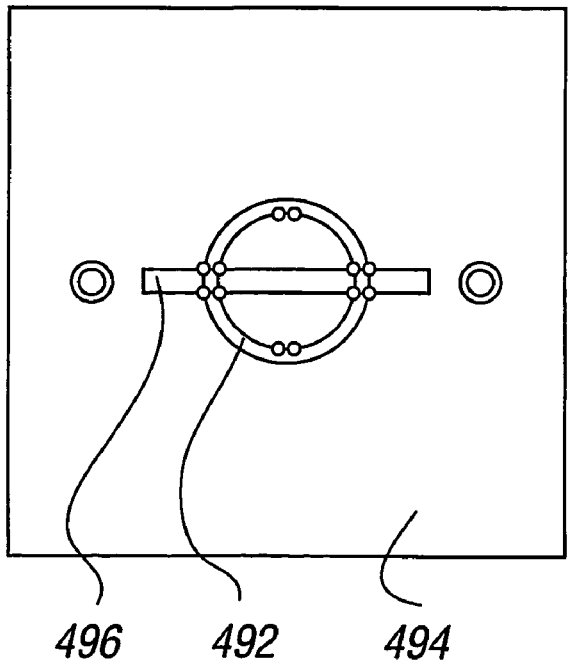

FIGS. 11A–D illustrate embodiments of cylindrical plug and socket arrangements for use with the cable of the invention;

FIGS. 12A–D illustrate embodiments of relatively planar plug and socket arrangements for use with the cable of the invention;

FIGS. 13A–B illustrate a surface mounting for a cylindrical socket;

FIGS. 14A–B illustrate a surface mounting for a relatively linear flat socket;

FIGS. 15A–B illustrate a combined flat and/or cylindrical cable surface mounting and FIGS. 16A–F illustrate graphically test results achieved utilising a cable in accordance with one embodiment of the invention.

Figure 1A:
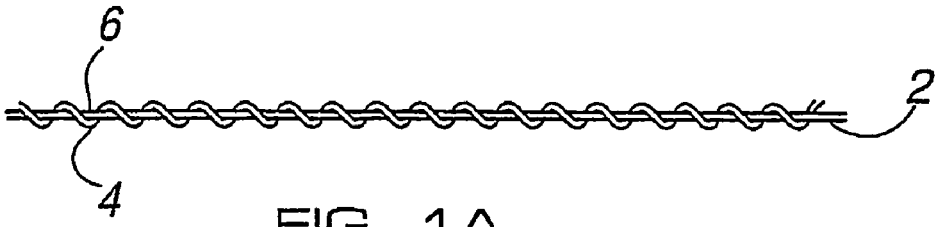

Referring firstly to FIG. 1A there is illustrated a first embodiment of a conductor. This comprises a conductor 4 wound around an insulating elongate member 6 which is shown, in this embodiment, to be straight with the conductor 4 wound in a spiral fashion along the length of the member 6. In this embodiment, the elongate member is formed of insulating material and therefore acts as an insulator but it should be appreciated that the same could be formed of a conducting material whether insulated or not and thereby act as a ground wire if required for certain instances. In any case this shows one form of conduction path or conductor set in accordance with the invention. The density/frequency of the windings can vary to suit specific performance requirements.

Figure 1B:
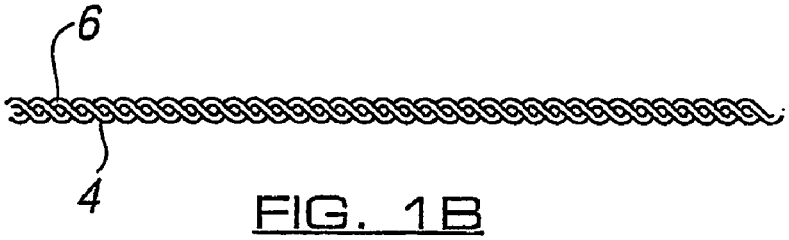

FIG. 1B illustrates another arrangement whereby the conductor 4 is twisted in conjunction with the elongate member 6 as shown to form a conductor set.

Figure 2A:
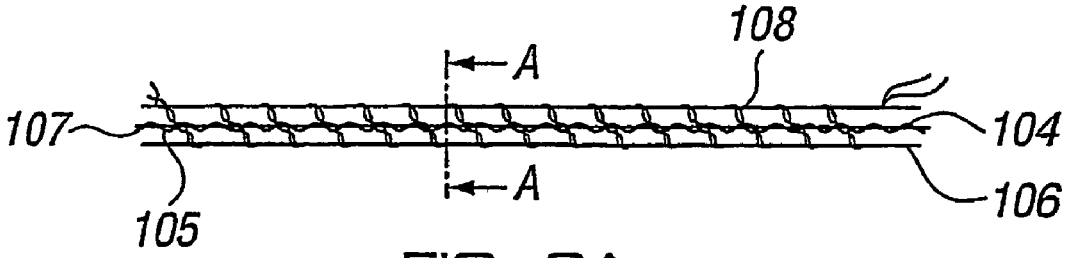
Figure 2B:
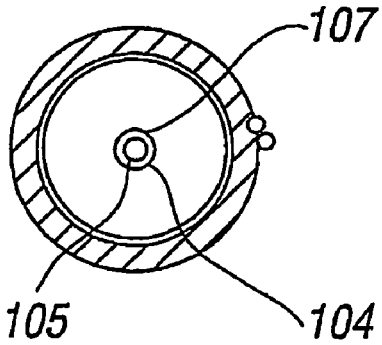

Turning now to FIGS. 2A and 2B there is illustrated an interconnecting cable according to one embodiment of the invention which is preferably used for audio, video and mains supply, but not exclusively so. There is provided an elongate member 105 and along the said member is wound a first conductor 104 to form a first conduction path formed by conductor set 107 which is shown in a wound manner similar to that of FIG. 1A. The conduction path 107 is placed inside a tube 106 of insulating material. Around the external wall of the tube 106 there is wound a second transmission core 108 formed in accordance, in this example, with the embodiment shown in FIG. 1A. Thus the insulating tube 106 acts to physically separate the two transmission cores 107, 108 of the cable. Yet further it is preferred but not exclusively that the two conductors are wound around their respective elongate members in opposite ways such that, for example the conductor 104 is wound clockwise and the conductor of core 108 is wound anticlockwise respectively. This serves to ensure that any interference created from each of the conductors is directed away from the other conductor thereby reducing the risk of cross-interference. Furthermore, it is preferable that the space between respective conductor windings is different between the two conductors thereby again minimising the risk of cross-interference.

FIG. 2B illustrates in cross section along line A—A, of FIG. 2A, the arrangements of the components of the interconnecting cable of FIG. 2A.

The degree or ration of the wind or twist of the conductors in each set may also be varied to allow optimum performance in specific areas and, if required, additional conductors may be used and twisted around if it is required that the cable carry larger currents. The use of a large diameter tube as indicated in FIG. 2A allows one of the conductors to be pulled through the inside and twisted there around with the other wound around the external wall and this constant change in the direction of the two conductors as shown in FIG. 2A creates an effective reduction in the magnetic interaction between the two conductors thereby improving the quality of signal transmission by reducing the interference acting on the same.

Figure 3A:
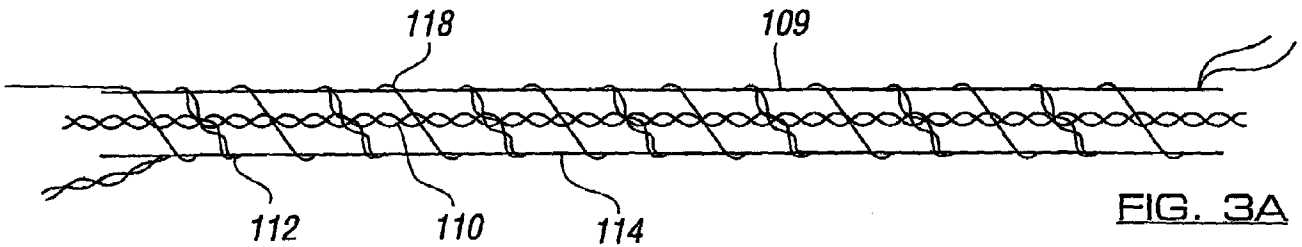
Figure 3B:
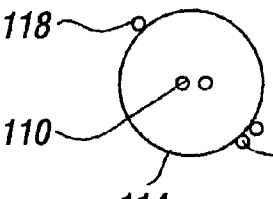
Figure 3C:
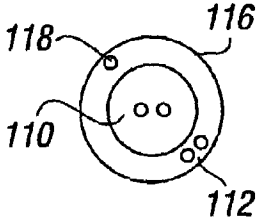

Referring to FIGS. 3A–C, there is illustrated a cable 109, preferably, but not exclusively used for audio, video and higher current applications. The conduction paths 110, 112 are formed by conductor sets and each include two conductors/insulators which are twisted or wound together. In one embodiment the degree of twist of the conductors in each set are at varying densities or ratios to each other. However in this case the conduction paths 110, 112 have the conductors with the same degree of twist. The conduction paths carry at least one current carrying conductor (ccc), depending on application. If two ccc's are required then it may be preferable to have the ccc wound around an insulated tube rather than twisted together either clockwise or anti-clockwise in respect to the elongate member. Typically, the arrangement, as shown in FIG. 3A–C, will constitute one current carrying cable although in some applications where there are two ccc's in a set, all four conductors will make up a set of ccc's i.e. Positive and Negative D.C. (Direct Current) applications—Phase and Neutral in A.C. (Alternating Current) applications. In any arrangement the signal can be discrete or analogous with respect to time. In FIG. 3B the outer conduction path 112 is mounted externally of the elongate member 114 and in practise would be enclosed by an outer housing (not shown). In FIG. 3C the outer conduction path 112 is enclosed within a housing 116 which acts as the outer housing and elongate member. In both embodiments a ground wire 118 is incorporated.

Figure 4B:
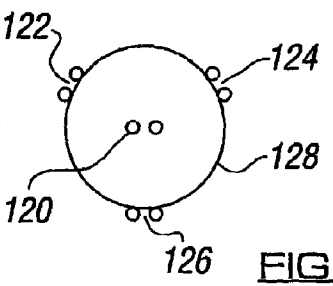
Figure 4A:
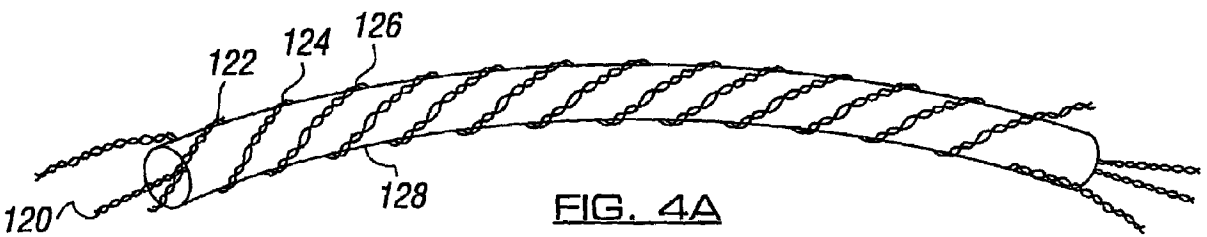

A four conduction path arrangement is required for data transmission and illustrated in FIGS. 4A–B. Typically, in this arrangement, all eight conductors are provided in the form of 4 conduction paths formed by conductor sets 120, 122, 124, 126 and each conducts and receives information.

Here, the conduction paths are current carrying conductors arranged as FIG. 4A. The twisting of the conductors will generally have varying densities or degrees of twist. The "inner" conduction path 120 has the tightest degree of twist and the other conduction paths have progressively less dense twist ratios between conductors. The three conduction paths 122, 124, 126 are spiralled around the tube 128 which acts as a housing for 120 and as a 'former' for the other sets to orbit. Each of the externally positioned sets are typically, though not exclusively, set at 120 degrees from each other as per the cross section of FIG. 4B. If more or less conduction paths are required then it is preferred that these be positioned equally distant from each other.

Figure 5A:
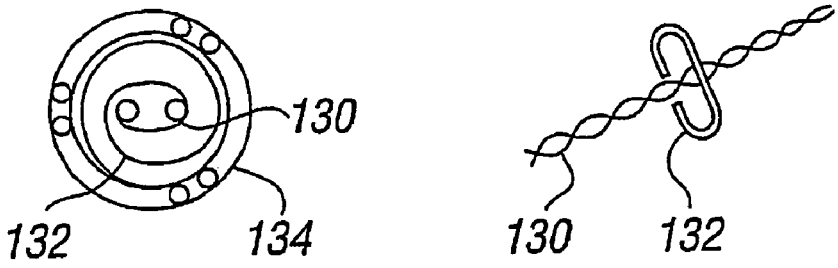
Figure 5B:
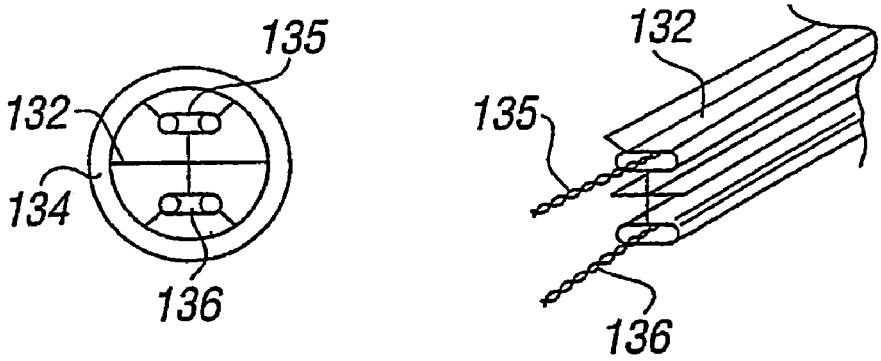
Figure 5C:
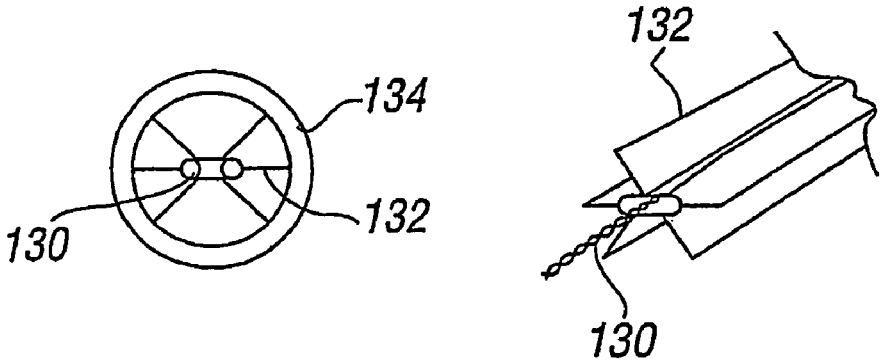
Figure 5D:
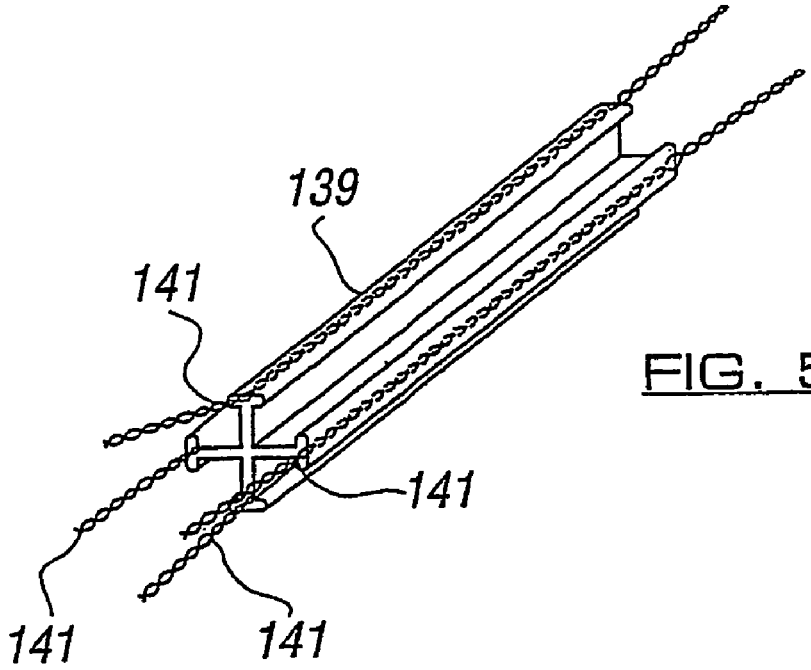
Figure 5E:
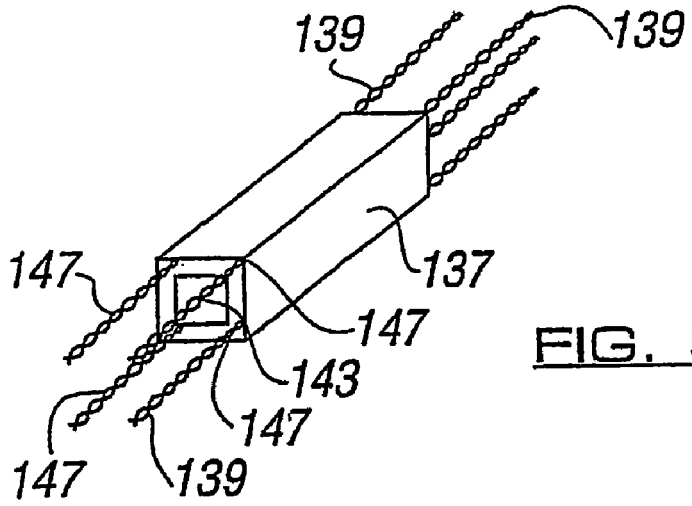
Figure 5F:
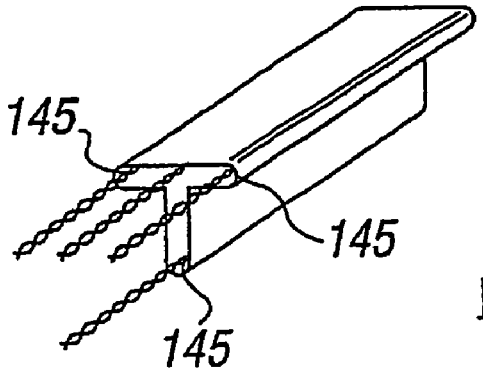

In FIGS. 5A–C there is illustrated how the inner conduction path formed by conductor set 130 can be located by a support member 132 within the elongate member 134. This can also allow the cable to house more than one conduction path formed by conductor sets 135, 136 as shown in FIG. 5B, located inside and, in FIGS. 5B and 5C, along, the elongate member. FIGS. 5D–F illustrate three further embodiments of cable and show how the elongate member 137 can be provided of a shape to suit specific requirements for cable use and/or conductor parameters. For example FIG. 5D illustrates an elongate member 137 with a cross shaped cross section, with a conductor set 139 positioned at the end of each of the arms 141 of the cross and in this case, with variations in the degree of twist of the conductors in each conductor set 139. FIG. 5E illustrates an elongate member 137 which has a central passage 143 and a conductor set provided at each corner 147. FIG. 5F illustrates an elongate member 137 with three arms 145 with conductor pairs positioned at the apex of the arms and at the end of each of the arms as shown.

In each case, the cable includes four sets of conductors and although not limited to such it is found that the embodiments described are of particular use when using four sets of conductors.

Figure 6:
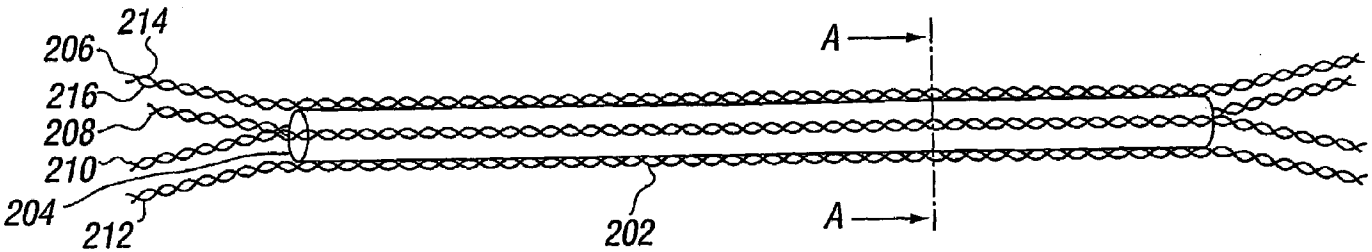
FIG. 6 illustrates an elevation of a length of cable in accordance with a further embodiment of the invention.
Figure 7:
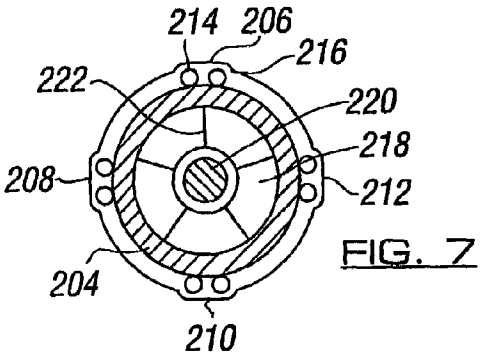
FIG. 7 illustrates a cross sectional elevation of the cable in FIG. 6 along line A—A.

Referring now to FIGS. 6 and 7, there is illustrated a length of cable 202 with the outer housing, typically acting as insulation and protection as is typically required, removed for ease of reference, although in one embodiment the conductor sets can be bonded to the outer wall of the core thus eliminating the need for the outer housing. This embodiment of cable is particularly although not exclusively, used in relation to data transmission. The length of cable 202 comprises, in addition to the removed outer insulation, a core 204 in the form of an elongate tube and four sets of conductors 206, 208, 210, 212.

Each set 206, 208, 210, 212, comprises two conductors 214, 216 which are illustrated with reference to conductor set 206 only for ease of reference. Each conductor in a set is wound round the other so as to form a twisted configuration as illustrated in FIG. 6. The degree of twist used can be the same for each of the sets 206, 208, 210, 212 or can be varied as required for use requirements but in each case, it is envisaged that the lower the degree of twist or "slacker" the twist that can be achieved without affecting the performance, the better as it reduces the material usage, the length, the attenuation and hence increases the propagation (speed) at which the signal arrives at the intended destination. Each of the conductor sets 206, 208, 210, 212, is provided in a linear path along the conductor core 204 in a plane substantially parallel with the longitudinal axis of the core. The linear path is preferred as it reduces the material used in comparison to the material used if the conductor sets are required to be wound around the core. The core 204 can be formed of insulating material, flexible or rigid, and the interior port 218 as shown in FIG. 8 which runs along the length of the cable, 202, can be used to carry further services such as, in this embodiment, a power supply 220.

It is preferred to keep the various conductor sets and other services apart by a distance of at least one but preferably more than 2 mm depending on the thickness of the tube. If this distance cannot be maintained the power supply 220 is held in a spaced relationship within the port 218 by means of a spacer arrangement 222 which has a series of arms which engage with the inner surface of the core so as to maintain the power supply cable 220 in a fixed position with respect to the inner surface of the core.

It should be appreciated that port 218 need not be used for further services and instead, if further cable rigidity is required, the interior of the core can be filled in and/or provided with other material to improve the rigidity of the cable.

Figure 8:
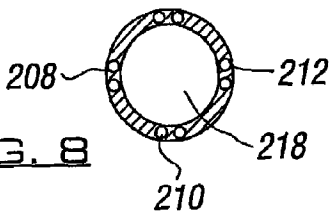
FIG. 8 illustrates an end elevation of a length of cable in accordance with a further embodiment of the invention.

In a further and perhaps preferred embodiment, the conductor sets 206, 208, 210, 212 are not provided on the outer surface of the core 204 but rather are provided as integral parts of the core wall as illustrated in FIG. 8 which provides an end elevation of a cable in this further embodiment. In this arrangement, the conductors in each set can be twisted as illustrated with regard to FIG. 6 and each set will follow the same path as illustrated in FIG. 6 with the exception that rather than lying on the outside of the core 204, the conductor sets are provided as integral parts of the wall of the core.

Furthermore, the interior port 218 of the core can be used in a similar manner as described with respect to FIG. 7. An advantage of this arrangement is that the outer insulation 224 around the core is not required and the finished product will not be uneven due to the provision of the conductor sets on an external surface of the core, but rather can be relatively smooth as it simply overlies the core. Indeed, it may also be possible for the outer layer of insulation to be not required, thus providing further cost savings.

For data transmission cables of the type herein described it is important that the crosstalk be kept to a minimum and to achieve this the conductor sets should be kept 1 mm or more preferably 2 mm apart, providing the twist density of the conductors in each set is sufficiently diverse. Typically, if the twist ratios for the conductors in each set are the same then the sets may need to be further spaced apart. As the difference in the twist ratios between sets increases, so the sets can be brought closer together and so, at least over a certain distance range, there is a link between the twist ratio difference value and how close the sets can be positioned together to give the optimum performance. Thus, it is another feature of the invention that there is provided a cable which includes a series of conductor sets, each of said sets including at least two conductors which are twisted/wound about one another to form the set and the twist ratio of each sets is compared with the twist ratios for each of the other sets and also the required spacing between the sets within the cable and on the basis of this comparison the twist ratios in the respective sets are varied to improve the performance of the cable. If the cable is, say round in cross section shape then the distance between the conductor sets can be 90 degrees and if, for example, two opposing sets are provided with tighter conductor twist ratios than the other two opposing conductor sets in a four conductor set cable, then a reduced cross sectional area can be achieved, by reducing the required spacing. As air is typically the best insulation available, if the conductor sets are twisted in different densities and placed at specified distances apart, the crosstalk is reduced to a minimum. The ratio between twist density ratios in each conductor set and spacing of the sets dictates the cable quality.

Figure 10:
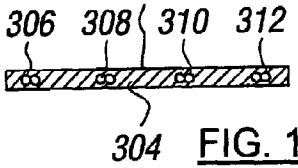
FIG. 10 illustrates a cross sectional elevation of the cable of FIG. 9 along line B—B.
Figure 9:
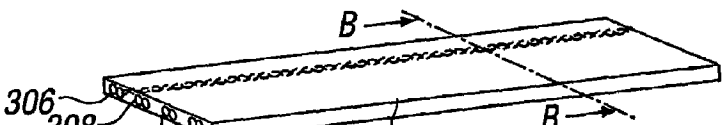
FIG. 9 illustrates a length of cable in accordance with a further embodiment of the invention.

FIGS. 9 and 10 illustrate a yet further embodiment of the invention where, in this embodiment, rather than the core 304 being in the form of a tube, the core along the length of cable 302 is relatively flat. In this arrangement, each of the conductor sets 306, 308 310 and 312 are again provided in a linear path parallel with the longitudinal axis of the core 304 and are spaced apart linearly. It should be appreciated that the core is provided with dimensions with respect to the conductor sets such that the required distance of 1 or preferably more than 2 mm apart can be achieved. It is also shown how, with respect to conductor set 306 for the purposes of illustration, in each set, the conductors are again twisted. Typically, the conductor sets are embedded within the core so that a relatively slim and easy to fit cable can be formed in accordance with this embodiment of the invention.

Figure 11A:
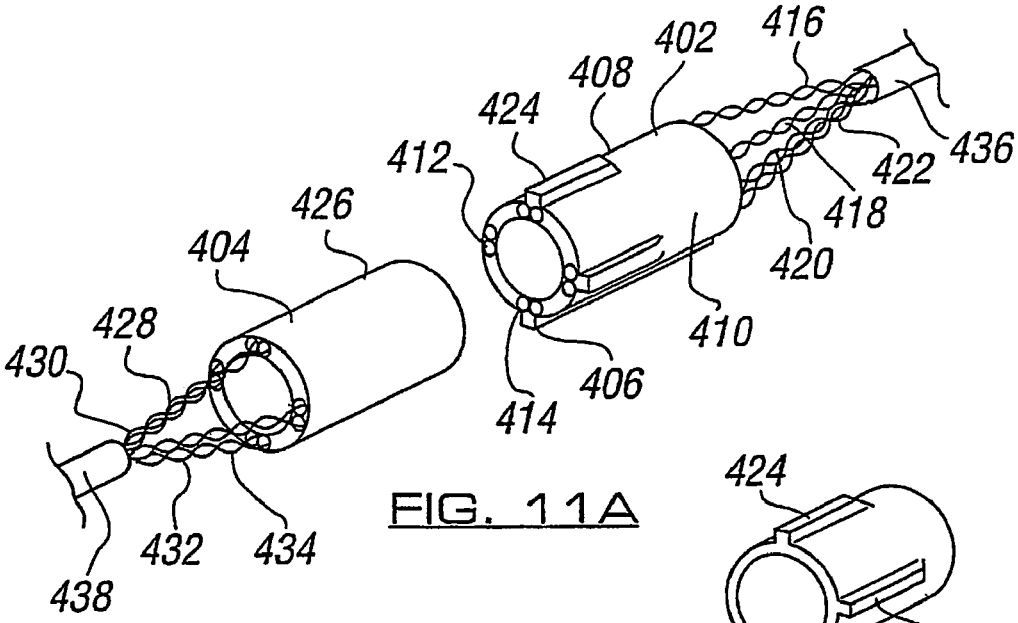
Figure 11C:
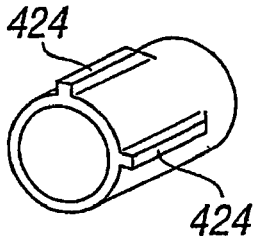
Figure 11B:
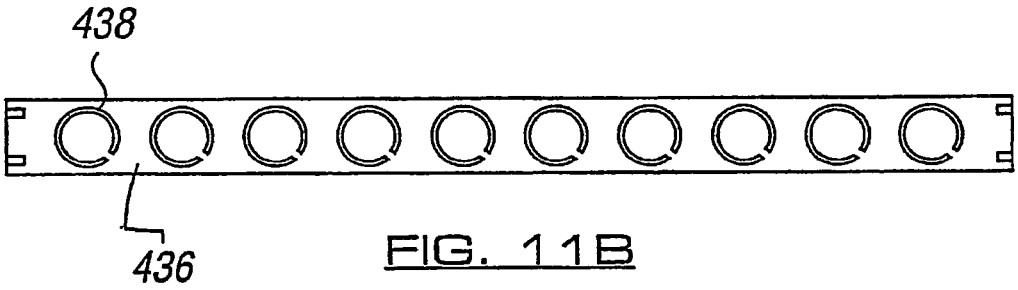
Figure 11D:
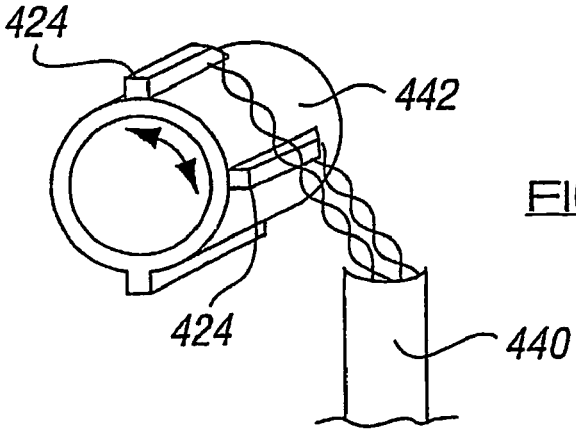

FIGS. 11A to D illustrate one embodiment of the plug and socket arrangement comprising a plug 402 and socket 404, with a locator key assembly 406 for location in a matching channel, not shown in the socket 404. In each of the plug and socket arrangements, there are provided four conductor set locations 408, 410, 412 and 414 each of which is spaced 90° apart to provide the required spacing between the conductor sets 416, 418, 420 and 422. Each of the conductor locations 408 to 414, is provided with an electrical contact 424. The contacts 424 in the plug are spring loaded so as to protrude from the external surface of the plug body such that when the same is inserted into the socket, the metallic contacts 424 contact with matching, static contacts 426 which are provided on the internal surface of the socket body. Thus, by insertion of the plug into the socket, connection of the conductor sets 416 to 422 can be achieved with the conductor sets 428 to 434. FIG. 11B illustrates a patch panel 436 which is a plurality of sockets 438 available for the insertion of the plugs of the type shown in FIG. 11A therein to allow the connection of a plurality of conductor cables. FIG. 11C illustrates how the spacing between the contacts 424 allows the spacing of the conductor sets connected thereto. Typically the particular spacing is dependent on the number of conductor sets to be located on the plug or socket so that, for example, if there are four sets of conductor sets the spacing is 360° divided by four which equals 90°, if there are five conductor sets the spacing is 72° and so on. However it is envisaged that there will always be spacing of at least 1 mm but preferably 2 mm between the conductor set locations in the plug and socket arrangement.

FIG. 11A illustrates the cables 436 and 438 located with respective plug and socket in a linear manner such that the longitudinal axes of the cables are in line with the longitudinal axis of the plug or socket. FIG. 11B illustrates an alternative arrangement where the longitudinal axis of cable 440 is perpendicular to the longitudinal axis of the plug 442 with conductor sets being wrapped round the plug body until they are connected to the respective contacts 424.

FIGS. 12A to D illustrate an alternative embodiment of the plug and socket arrangement and it should be appreciated that either embodiment of FIGS. 11A to D or 12A to D can be used in conjunction with flat cables or the circular cable arrangements as described with respect to the previous figures.

Figure 12A:
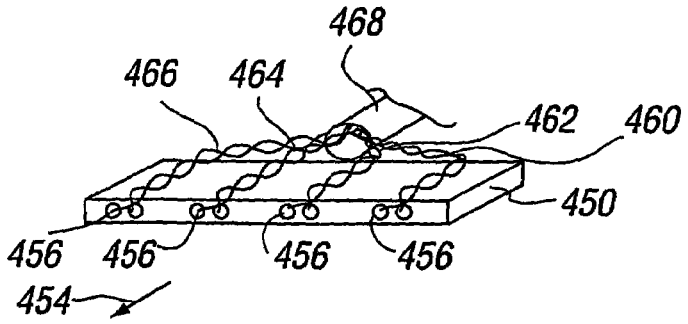
Figure 12B:
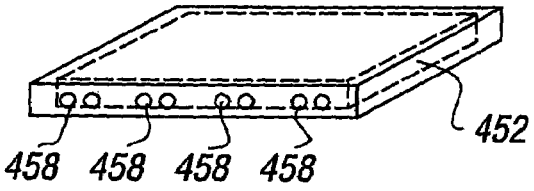
Figure 12C:
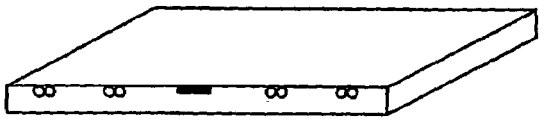
Figure 12D:
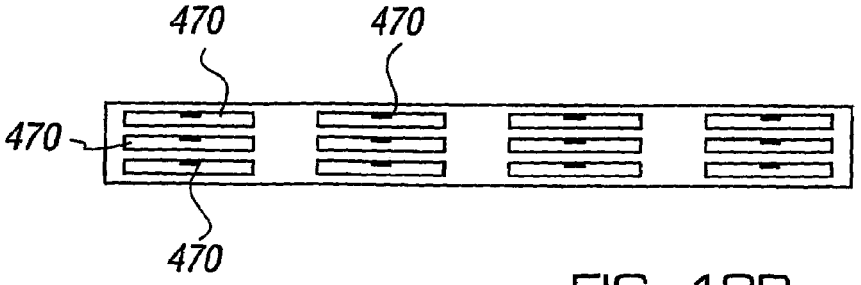

In FIGS. 12A to D, there is provided a relatively planar plug 450 and a relatively planar socket 452. The socket is provided with an aperture, indicated by broken lines, which allows for the reception therein of the plug as indicated by arrow 454. When located, the contacts 456 contact with contacts 458 mounted at the rear of the socket and, as the contacts 456 are each located with a conductor set 460, 462, 464, 466, so contact can be made between the cable 468 connected to the plug and a cable or other data carrier means connected to the socket at the rear face thereof. FIG. 12D illustrates a patch panel arrangement whereby a plurality of sockets 470 are provided, each for location of a plug 450 as illustrated in FIG. 12A. FIGS. 13A and B illustrate a surface mounted panel 472 which can be located on a wall with a rear protrusion 474 mounted in an aperture formed in the wall surface. This surface mounted plate, includes a socket arrangement 476 into which a plug of the type shown in FIGS. 11A to D can be inserted to allow contact with the contacts 478 mounted in the socket as shown. There is also provided a dust cover 480 which can be spring loaded and which can be raised to allow the plug to be inserted into the socket.

FIGS. 14A and B illustrate similar arrangements to that of FIGS. 13A and B with the exception that the socket in the front surface is arranged for location of a relatively planar socket arrangement of the type shown in FIGS. 11A to D. In this case, the socket 482 is provided with linearly spaced contacts 484. The rear panel 486 allows a connection to further cabling behind the wall.

FIGS. 13A and 9B illustrate how the external face of a socket 490 can be provided with a socket arrangement 492 of a first type but at the rear face 494 the socket can be provided to allow the connection thereto of a plug or cable arrangement of an alternative form such that, in this case, a relatively circular socket is provided on the external surface 490 and relatively planar socket or plug 496 is provided on the rear surface to suit particular cabling requirements. It should also be appreciated that this arrangement can be reversed to suit particular requirements.

Figure 16A:
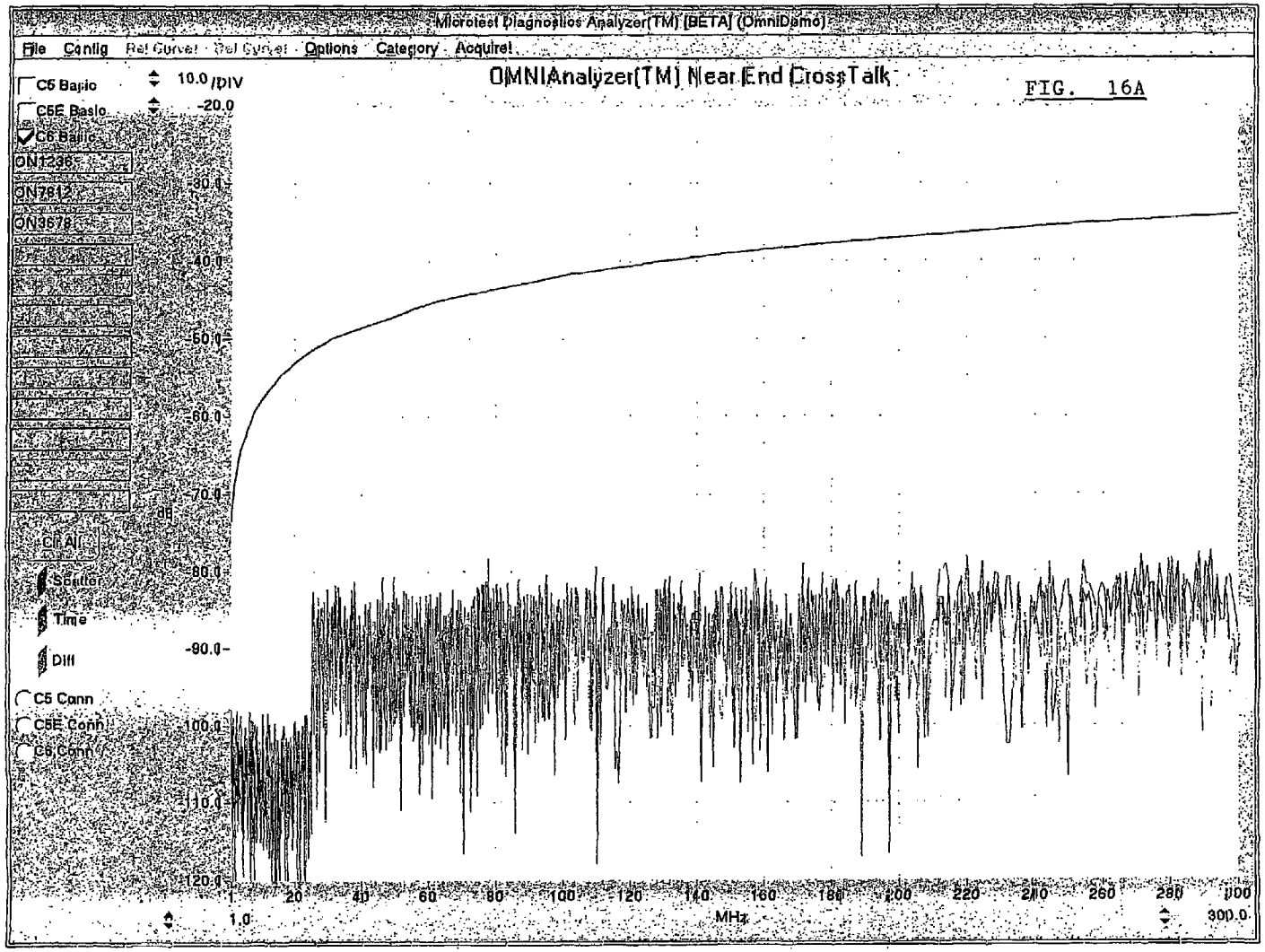

FIGS. 16*a–f* illustrate clearly how the cable in accordance with the invention performs in a far superior manner to the best conventionally available cable. Each figure illustrates a graph of cross talk analysis as the frequency increases. FIG. 16*a* is used as a reference for the measuring apparatus, a Microtest Diagnostics analyser and shows the results obtained when there is no cable present.

Figure 16B:
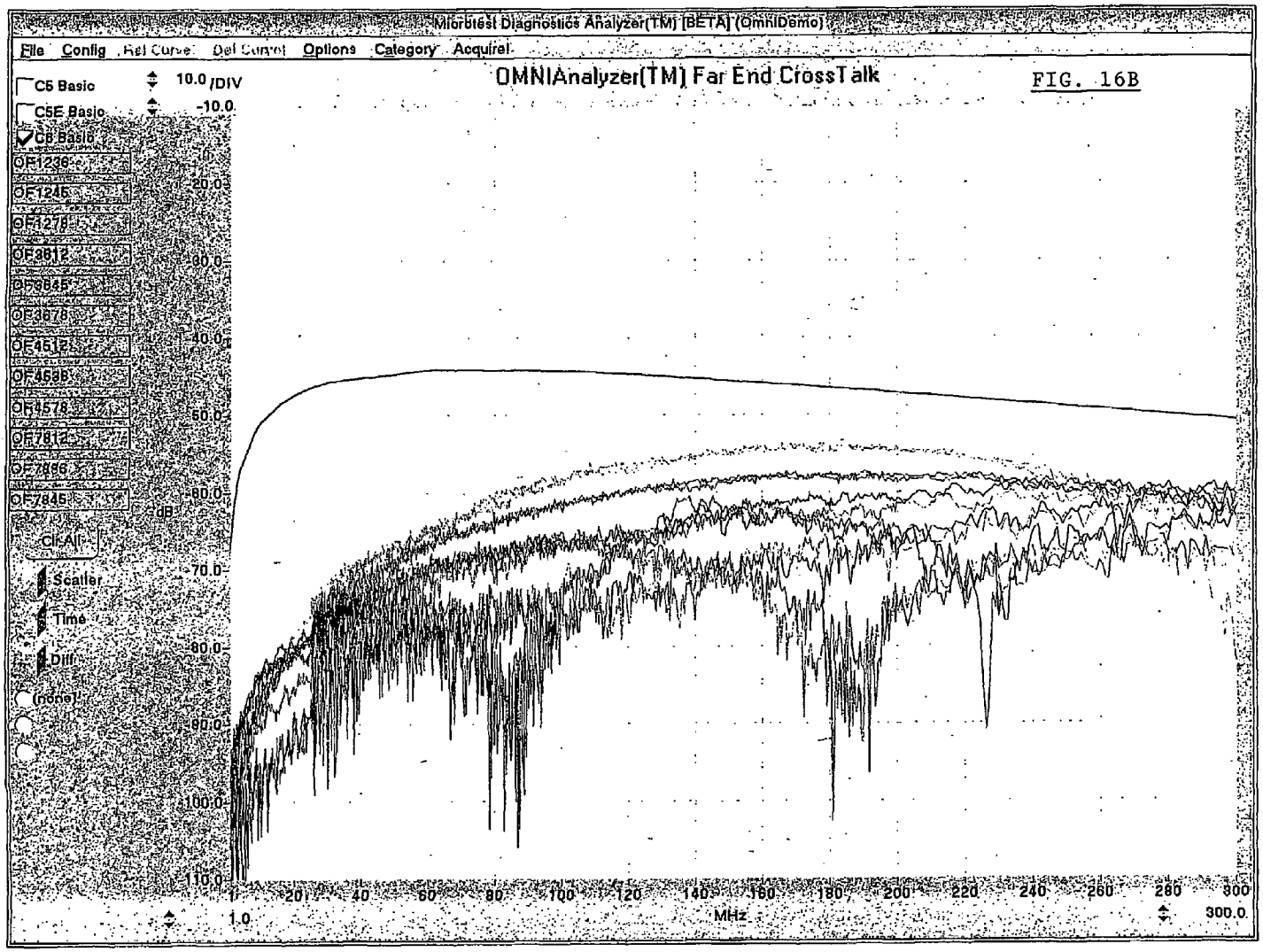
Figure 16C:
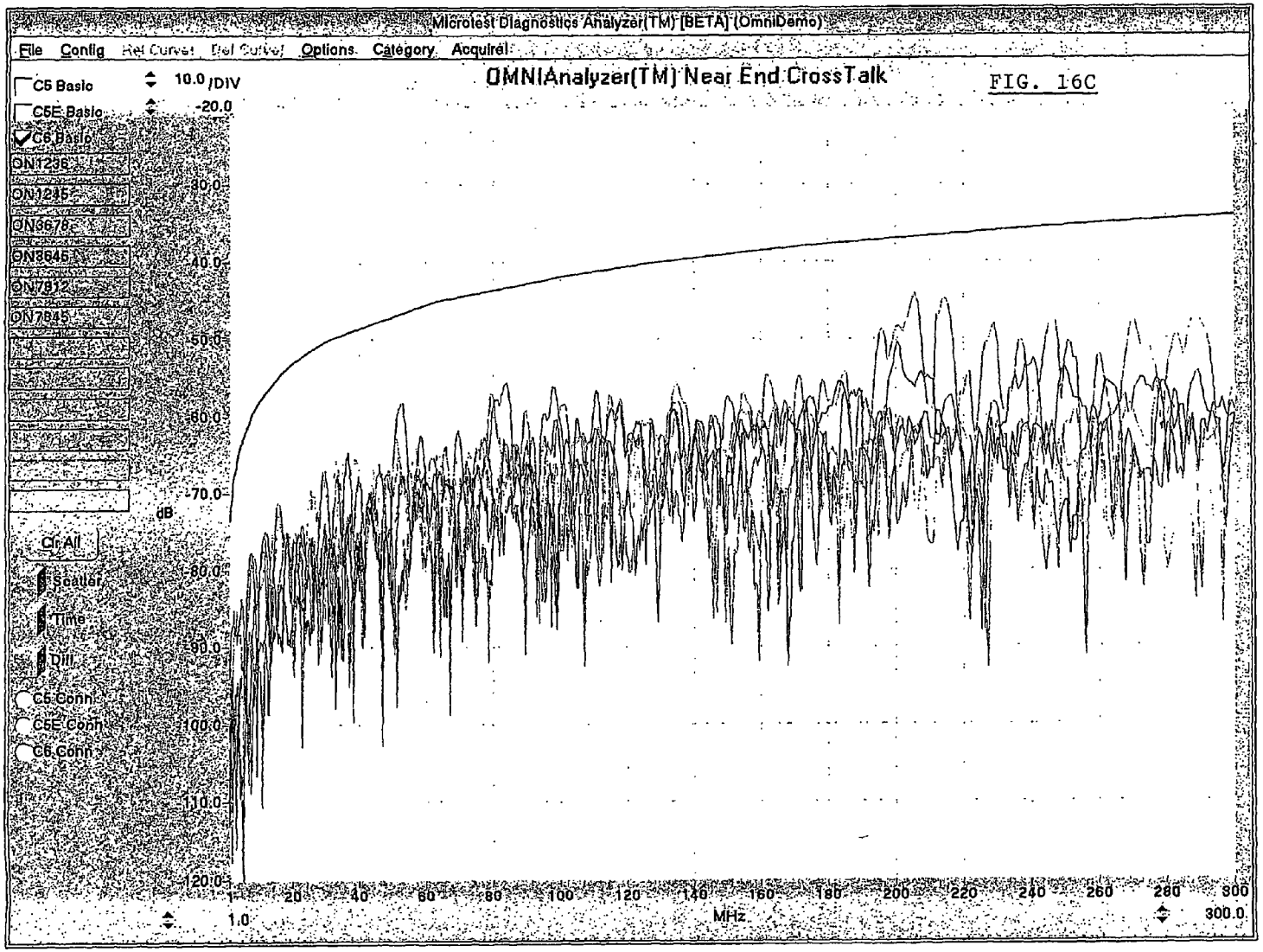
Figure 16D:
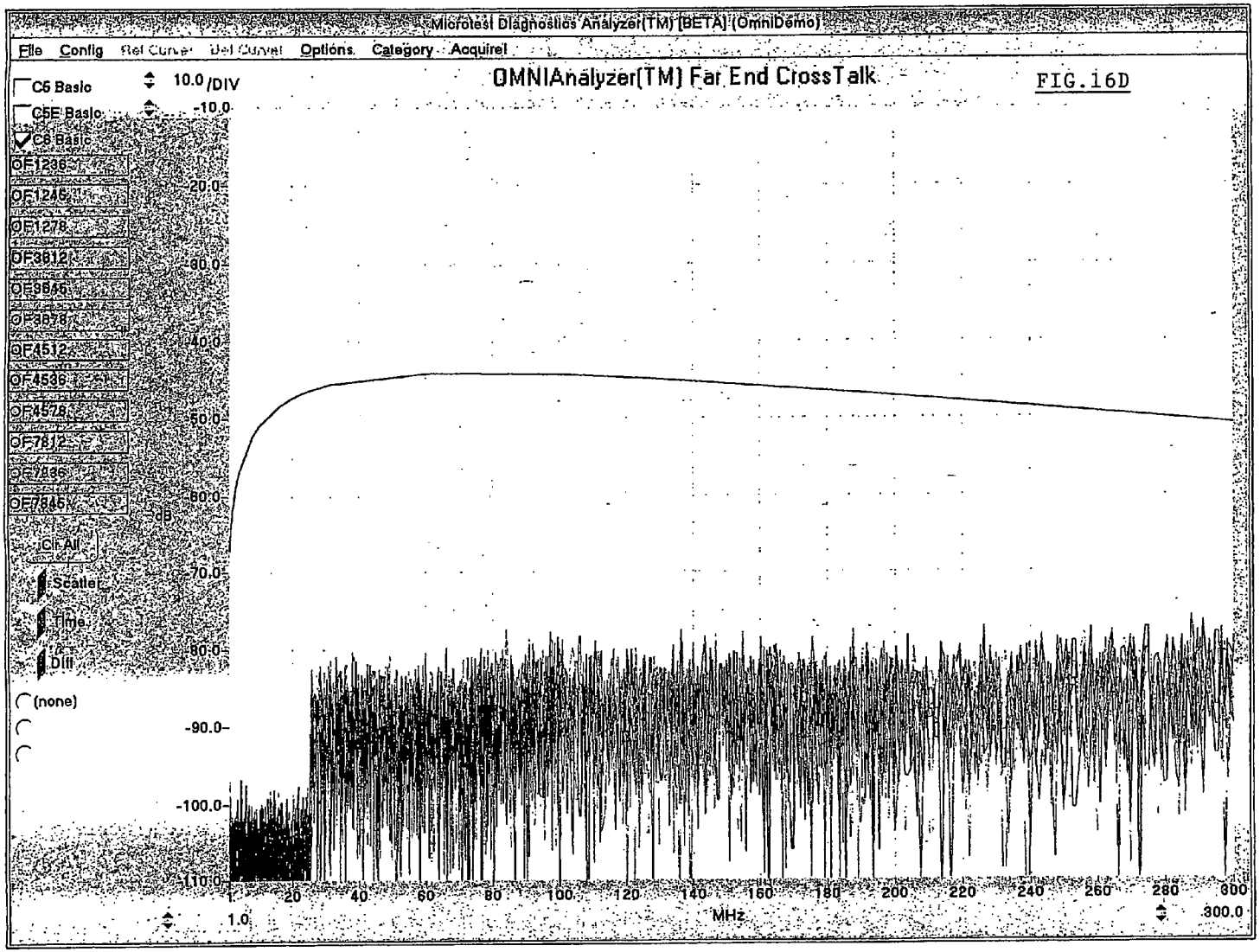
Figure 16E:
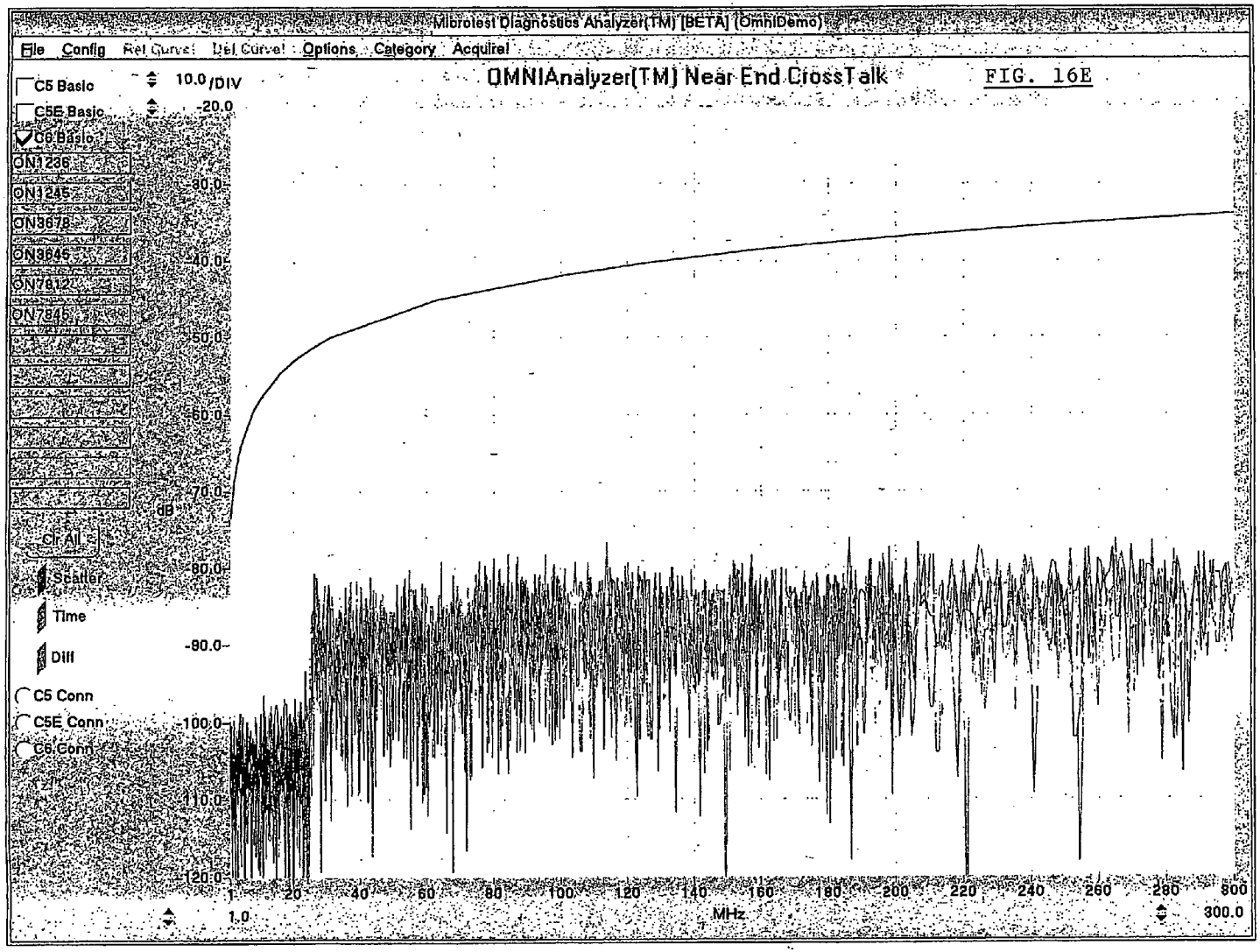
Figure 16F:
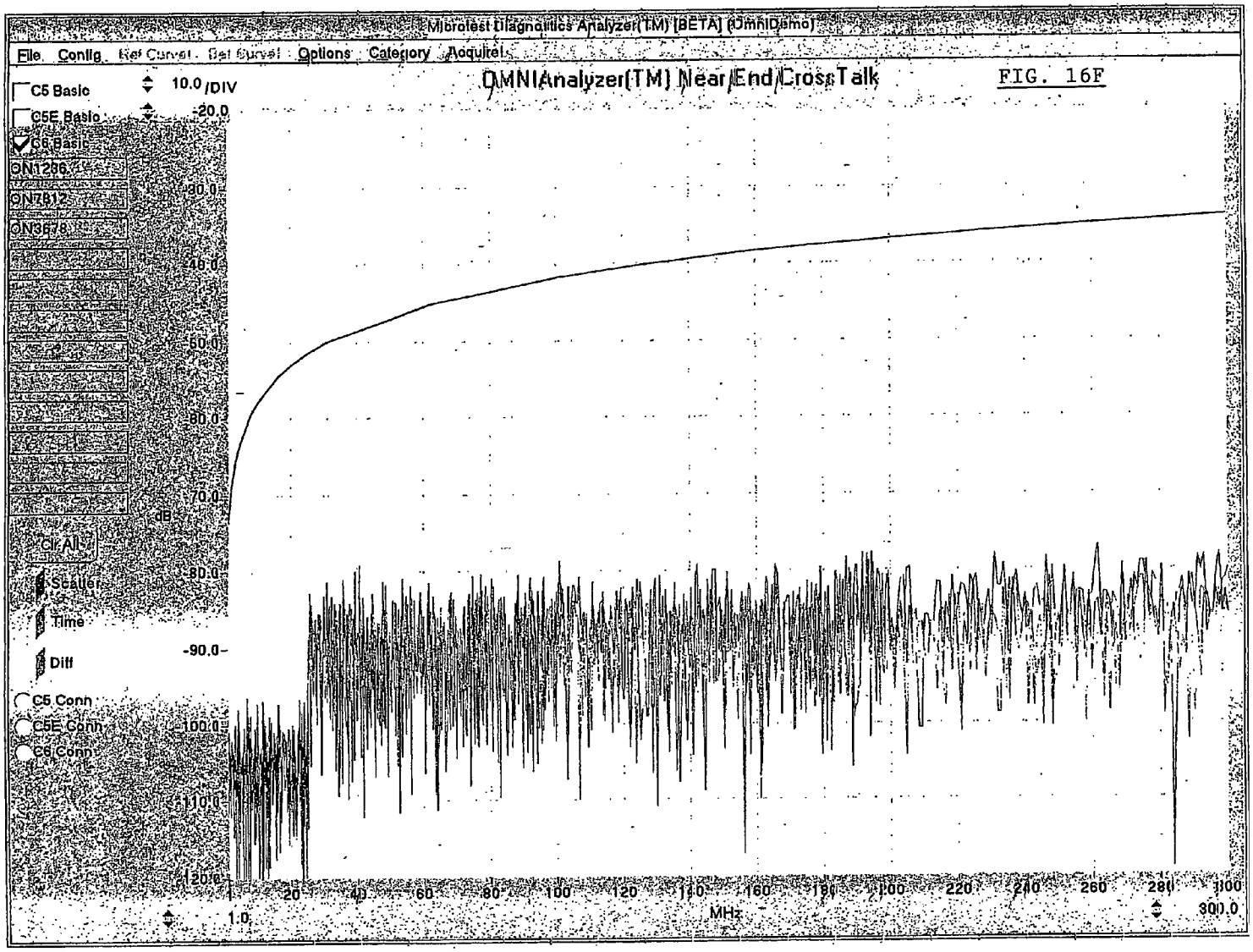

FIGS. 16*b* and *c* show the results obtained when 50 metres of conventionally available category 6 cable are tested at the near and far end and it is immediately apparent from the trace that there is a significantly poor comparison with respect to the trace of FIG. 16*a*, i.e. there is significant cross talk present on the cable tested in the conventional cable.

FIGS. 16 *d* and 16*e* illustrate the results of the same test performed on 50 metres of cable formed in accordance with the invention in the embodiment illustrated in FIG. 6 with a cross sectional area to suit particular requirements and circular in shape and with four conductor sets, a first set having a degree of twist ratio or density of 8 mm i.e. one complete twist over an 8 mm length, a second set having a degree of twist or density of 10 mm, the third set having a degree of twist or density of 12 mm and the fourth set having a degree of twist or density of 14 mm. It is immediately apparent that there is very little deterioration in the performance of the cable in comparison with the reference trace of FIG. 16*a* i.e. there is hardly any cross talk effect. As such, comparison with the graphs of FIGS. 16*b* and *c* show clearly improved results are obtained using the cable in accordance with the invention. To emphasise this beneficial effect FIG. 16*f* shows the test results performed over 150 metres of the FIG. 6 cable.

It is therefore clear that the cable according to the invention can provide far better performance characteristics than one of the best currently available cables and, furthermore can provide results which are close to the reference trace of FIG. 16*a*.

As well as the conducting material (quality and purity) the insulating material will have an effect upon performance of the design. In the case of the conductors, substances formed by slow extrusion process utilising low oxygen content, high purity material will perform better than faster extruded, higher oxygen content, lower purity substances. All conducting material types and shapes and sizes e.g. circular, square, triangular etc. in cross section may be used.

If the cable is to be used for high current and or voltage applications then the Cross Sectional Area of the cable will be greatly increased from that of signal cables where the 'skin-effect' becomes an issue in terms of power loss. The idea of using more than one conductor in this arrangement to make up a 'cable' will reduce this effect from current single core types.

The above description therefore indicates the basis of the current patent application with regard to the overall geometry of the cable. It is also known that the type and purity of materials chosen are important factors and the dielectric materials selected can be used to suit specific needs and requirements and equally, the termination point plugs for connecting the cable to the electrical equipment can be provided to suit the specific equipment and use of cable.

Use of the cable has been found to greatly reduce interference and therefore signal loss of electrical components and to reduce the distortion caused between the cable conductors. It should also be appreciated that the drawings show a single conductor cable but multi conductor cables can be formed using multiples of conductor cable preferably all in accordance with the invention, as required.

Finally, it should be appreciated that the invention herein described is of advantage when used in the transmission of any electrical signals, whether analogue, digital, AC or DC and for a whole range of uses.

The invention claimed is:

1. A cable comprising at least two conductor sets provided to run along the length of said cable, each of said conductor sets including at least two conductors twisted or wound around each other, said conductor sets kept physically spaced apart as they run along said cable, said cable further including an elongate member which spaces said conductor sets apart by a distance of at least 1 mm along the cable and wherein said elongate member acts as an elongate spacing member comprising a core or wall and said conductor sets are located within said core or wall as integral parts, wherein said elongate member has a cross shaped cross section and each of said conductor sets is located at an end of one of the arms of the cross shaped cross section.

2. A cable according to claim 1 wherein said conductor sets are spaced apart by 2 mm or greater distance.

3. A cable according to claim 1 wherein said elongate member has a passage housing at least one of said conductor sets.

4. A cable according to claim 3 wherein said passage is provided with location means to locate the conductor set therein.

5. A cable according to claim 1 wherein the degree of twist or winding of conductors in at least one of the sets of conductors differs from that of the conductors in the other conductor sets in the cable.

6. A cable according to claim 5 wherein the variation between the degree of twist or winding of the conductors in each of the conductor sets differs with respect to each of the other conductor sets and the degree of variation is defined with respect to the relative spacing between the adjacent conductor sets.

7. A cable according to claim 1 wherein said conductor sets are positioned to run substantially straight along the cable.

8. A cable according to claim 7 wherein said cable comprises four sets of conductors, each set comprising at least two conductors twisted or wound, and each of the sets spaced from each other by at least 1 mm.

9. A cable according to claim 8 wherein said cable cross section is substantially circular and the conductor sets are spaced apart substantially 90 degrees between adjacent sets.

10. A cable according to claim 1 wherein each of said conductors is insulated from the others by insulating material and the cable includes an outer housing of insulating material.

11. A cable according to claim 1 wherein said elongate member is in the form of a tube.

12. A cable according to claim 1 wherein the longitudinal axes of each of the conductor sets run, substantially parallel to the longitudinal axis of the elongate member.

13. A cable according to claim 1 wherein the degree of twist or winding of the conductors in each conductor set is varied with respect to that of the other sets of conductors.

14. A cable according to claim 13 wherein a degree of difference in the twist or winding between sets is increased as the spacing between the respective conductor sets is reduced.

15. A cable according to claim 1 wherein at least one conductor set passes along a passage in said elongate member and substantially in parallel with the longitudinal axis of the cable.

16. A cable according to claim 1 wherein a passage in said elongate member carries mains power supply therealong.

* * * * *